US011766758B2

(12) United States Patent
Ho et al.

(10) Patent No.: US 11,766,758 B2
(45) Date of Patent: Sep. 26, 2023

(54) CHEMICAL MECHANICAL POLISHING APPARATUS USING A MAGNETICALLY COUPLED PAD CONDITIONING DISK

(71) Applicant: Taiwan Semiconductor Manufacturing Company Limited, Hsinchu (TW)

(72) Inventors: Wen-Pin Ho, Zhubei (TW); Ren-Hao Jheng, Hsinchu (TW); S. P. Cheng, Hsinchu (TW)

(73) Assignee: Taiwan Semiconductor Manufacturing Company Limited, Hsinchu (TW)

( * ) Notice: Subject to any disclaimer, the term of this patent is extended or adjusted under 35 U.S.C. 154(b) by 235 days.

(21) Appl. No.: 17/159,376

(22) Filed: Jan. 27, 2021

(65) Prior Publication Data

US 2022/0234165 A1 Jul. 28, 2022

(51) Int. Cl.
*B24B 37/04* (2012.01)
*B24B 37/20* (2012.01)

(52) U.S. Cl.
CPC ..... *B24B 37/042* (2013.01); *B24B 37/20* (2013.01)

(58) Field of Classification Search
CPC ..... B24B 1/00; B24B 7/228; B24B 37/20; B24B 37/24; B24B 37/30; B24B 37/042; B24B 41/061; B24B 45/006; B24B 53/017; B24B 53/005; B24B 53/02
USPC ..... 451/41, 56, 287, 290, 443, 451
See application file for complete search history.

(56) References Cited

U.S. PATENT DOCUMENTS 6,960,114 B2 * 11/2005 Lee ..... B24B 53/017 451/72
7,217,172 B2 * 5/2007 Benner ..... B24B 53/017 451/72
11,565,370 B2 * 1/2023 Bosio ..... B24B 27/0038
2011/0097977 A1 * 4/2011 Bubnick ..... B24B 53/017 451/487

(Continued)

FOREIGN PATENT DOCUMENTS

JP 2000190201 A * 7/2000 ..... B24B 37/04
KR 20060109526 A * 10/2006

OTHER PUBLICATIONS

Machine translation KR-20060109526-A (Year: 2006).*
Machine translation of JP-2000190201-A (Year: 2000).*

*Primary Examiner* — Orlando E Aviles
*Assistant Examiner* — Robert F Neibaur
(74) *Attorney, Agent, or Firm* — The Marbury Law Group, PLLC

(57) ABSTRACT

A chemical mechanical polishing (CMP) apparatus includes a polishing pad located on a top surface of a platen configured to rotate around a vertical axis passing through the platen, a wafer carrier configured to hold a substrate on a bottom surface thereof and to press the substrate on a top surface of the polishing pad, a slurry dispenser configured to dispense slurry over the top surface of the polishing pad, and a pad conditioning unit comprising a pad conditioning disk and a conditioning head configured to hold the pad conditioning disk. The conditioning head includes an electromagnet and the pad conditioning disk comprises a first ferromagnetic material portion configured to be attracted to the electromagnet when the electromagnet is energized.

20 Claims, 5 Drawing Sheets

(56) References Cited

U.S. PATENT DOCUMENTS

| | | | | |
|---|---|---|---|---|
| 2014/0179204 | A1* | 6/2014 | Shinozaki | B24B 53/017<br>451/443 |
| 2020/0246936 | A1* | 8/2020 | Shinozaki | B24B 37/16 |

* cited by examiner

CHEMICAL MECHANICAL POLISHING APPARATUS USING A MAGNETICALLY COUPLED PAD CONDITIONING DISK

BACKGROUND

Chemical mechanical polishing apparatuses are used to provide a planarization process during semiconductor manufacturing.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
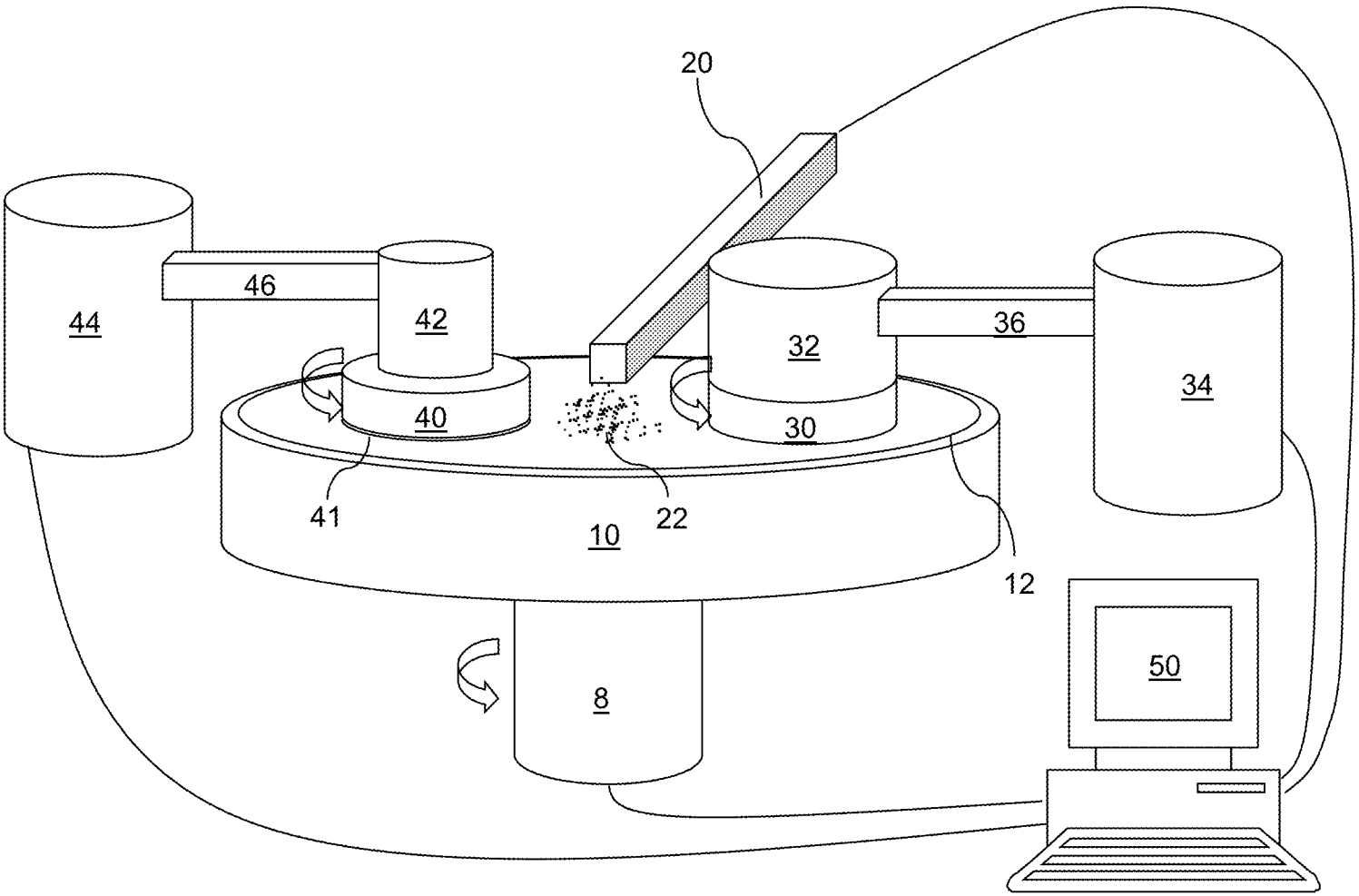
FIG. 1 is a schematic perspective view of a chemical mechanical polishing apparatus according to an embodiment of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Chemical mechanical polishing (CMP) is used in semiconductor manufacturing to enable an abrasive planarization process that provides a highly planar surface. A CMP apparatus includes a rotating platen with a polishing pad thereupon, a wafer carrier configured to hold and press a wafer against a top surface of the polishing pad, and a slurry dispenser. A CMP apparatus may optionally include a pad conditioning unit containing a pad conditioning disk. Pad conditioning disks are configured to be attached to a conditioning head of the pad conditioning unit by multiple mechanical fasteners, for example screws. However, in conventional pad conditioning disks, such screws tend to loosen during operation of a CMP apparatus. As a consequence, the loosened screws may cause degradation in the quality of the pad surface. Further, repair of a loose screw or dislodged screw requires a significant tool down time and reduces availability of a CMP apparatus. In addition, the mechanical fasteners may be susceptible to rust and corrosion. The rust may cause unwanted scratching of the wafer surfaces that are intended for CMP processing.

Various embodiments are disclosed herein which eliminate the need for a mechanical fastener to affix the pad conditioning disk in place. Various embodiments use a magnetically coupled pad conditioning disk to eliminate the use of any screw of any other mechanical fixture elements that may become loose or dislodged during operation. Such elimination of a mechanical fastener may reduce the tool down time and increase the availability of a CMP apparatus for production. The various aspects of the present disclosure are described in detail herebelow.

FIG. 1 is a schematic perspective view of a chemical mechanical polishing apparatus according to an embodiment of the present disclosure. Referring to FIG. 1, a chemical mechanical polishing (CMP) apparatus according to an embodiment of the present disclosure includes a polishing pad 12 located on a top surface of a platen 10, a wafer carrier 40 configured to hold a substrate 41 upside down, a slurry dispenser 20 configured to dispense slurry 22 over the top surface of the polishing pad 12, and a pad conditioning unit (30, 32) that is used to condition the top surface of the polishing pad 12.

The platen 10 may have a generally cylindrical shape, and may have a circular top surface that is large enough to accommodate the polishing pad 12. The polishing pad 12 may have a circular shape with a diameter that is at least twice the diameter of the substrate 41. For example, if the diameter of the substrate 41 is 300 mm, the diameter of the polishing pad 12 may be at least 600 mm. If the diameter of the substrate 41 is 450 mm, the diameter of the polishing pad 12 may be at least 900 mm. Generally, the ratio of the diameter of the polishing pad 12 to the diameter of the substrate 41 may be in a range from 2 to 6, such as from 2.5 to 4. The polishing pad 12 includes asperities and pores that define the pad texture. The asperities and pores may be arranged into unit cells that are repeated across the polishing pad and to provide uniform pressure across the substrate 41 during polishing.

The platen 10 may be configured to rotate around a vertical axis passing through the geometrical center of the platen 10. For example, a platen motor assembly 8 may be provided underneath the platen 10 to provide a rotational motion to the platen 10 around the vertical axis passing through the geometrical center of the platen 10. The platen 10 may be configured to provide a rotational speed in a range from 10 revolutions per minute to 240 revolutions per minute.

The wafer carrier 40 may be configured to hold the substrate 41 on a bottom surface thereof, and to press the substrate 41 onto the top surface of the polishing pad 12. In one embodiment, the wafer carrier 40 may include a vacuum chuck configured to provide suction to the backside of the substrate 41. In one embodiment, differential suction pressures may be applied across different backside areas of the substrate 41. For example, the suction pressure applied to the center portion of the substrate 41 may be different from the suction pressure applied to the peripheral portion of the substrate 41 to provide uniform polishing rate across the entire area of the front side of the substrate 41 that contacts the polishing pad 12. In one embodiment, the wafer carrier 40 may include a retaining ring having an annular shape and configured to hold the substrate 41 therein so that the substrate 41 does not slide out from underneath the wafer carrier 40.

A polishing head 42 may be provided over the wafer carrier 40. The polishing head 42 may comprise a rotation mechanism that provides rotation to the wafer carrier 40. In some embodiments, a gimbal mechanism may be provided between the rotation mechanism and the wafer carrier 40 so that the wafer carrier 40 tilts in a manner that provides maximum physical contact between the entire front surface of the substrate 41 and the polishing pad 12. The combination of the polishing head 42 and the wafer carrier 40 constitutes a wafer polishing unit (40, 42) that positions and rotates the substrate 41 in a manner that induces polishing of material portions on the front side of the substrate 41 through abrasion caused by sliding contact with the top surface of the polishing pad 12.

In one embodiment, the substrate 41 and the wafer carrier 40 may rotate around the vertical axis passing through the geometrical center of the wafer carrier 40. A polishing pivot pillar structure 44 may be affixed to a frame (not shown) of the CMP apparatus such that the polishing pivot pillar structure 44 may rotate around a vertical axis passing through the geometrical center of the polishing pivot pillar structure 44. The vertical axis passing through the geometrical center of the polishing pivot pillar structure 44 is stationary relative to the frame of the CMP apparatus.

A polishing arm 46 mechanically connects the polishing head 42 to the polishing pivot pillar structure 44. Thus, upon rotation of the polishing pivot pillar structure 44 around the vertical axis passing through the geometrical center of the polishing pivot pillar structure 44, the polishing arm 46 may rotate around the vertical axis passing through the geometrical center of the polishing pivot pillar structure 44. The polishing head 42 may move around the vertical axis passing through the geometrical center of the polishing pivot pillar structure 44 over the polishing pad 12. Lateral movement of the wafer polishing unit (40, 42) over the polishing pad 12 may enhance uniformity of polish rate across the substrate 41 during the chemical mechanical polishing process.

The slurry dispenser 20 is configured to dispense the slurry 22 over the top surface of the polishing pad 12. The slurry 22 may include any slurry known in the art, such as commercially available slurries for chemical mechanical polishing processes.

The pad conditioning unit (30, 32) may be used to precondition the polishing pad 12 prior to, and/or during, the chemical mechanical polishing process that is used to polish material portions from the front surface of the substrate 41 that contacts the top surface of the polishing pad 12. In one embodiment, the pad conditioning unit (30, 32) may include a pad conditioning disk 30 and a conditioning head 32 that is configured to hold the pad conditioning disk 30. The pad conditioning disk 30 includes an abrasive bottom surface that can precondition the top surface of the polishing pad 12. Typically, the abrasive bottom surface of the pad conditioning disk 30 embeds abrasive particles such as diamond particles. The pad conditioning disk 30 may be attached to the conditioning head 32 in a manner that enables rotation of the pad conditioning disk around a vertical axis passing through the geometrical center of the pad conditioning disk 30 without falling out from the conditioning head 32.

A conditioner pivot pillar structure 34 may be affixed to a frame (not shown) of the CMP apparatus such that the conditioner pivot pillar structure 34 may rotate around a vertical axis passing through the geometrical center of the conditioner pivot pillar structure 34. The vertical axis passing through the geometrical center of the conditioner pivot pillar structure 34 is stationary relative to the frame of the CMP apparatus.

A pad conditioner arm 36 mechanically connects the conditioning head 32 to the conditioner pivot pillar structure 34. Thus, upon rotation of the conditioner pivot pillar structure 34 around the vertical axis passing through the geometrical center of the conditioner pivot pillar structure 34, the pad conditioner arm 36 may rotate around the vertical axis passing through the geometrical center of the conditioner pivot pillar structure 34. The conditioning head 32 may move around the vertical axis passing through the geometrical center of the conditioner pivot pillar structure 34 over the polishing pad 12. Lateral movement of the pad conditioning unit (30, 32) over the polishing pad 12 may enhance uniformity of the surface condition of the polishing pad 12 after the pad preconditioning process.

Embodiments of the CMP apparatus may include a process controller 50 electrically connected to electrical components that control movement of various mechanical parts of the CMP apparatus. For example, the process controller 50 may be electrically connected to, and may be configured to control operation of, each of the platen motor assembly 8, the polishing pivot pillar structure 44, the wafer polishing unit (40, 42), the conditioner pivot pillar structure 34, the pad conditioning unit (30, 32), and the slurry dispenser 20. For example, the process controller 50 may control the rotational speed of the platen 10, the polishing pivot pillar structure 44, the wafer carrier 40, the conditioner pivot pillar structure 34, and the pad conditioning disk 30, and may control the location of the slurry dispensation point and the rate of slurry dispensation.

Figure 2:
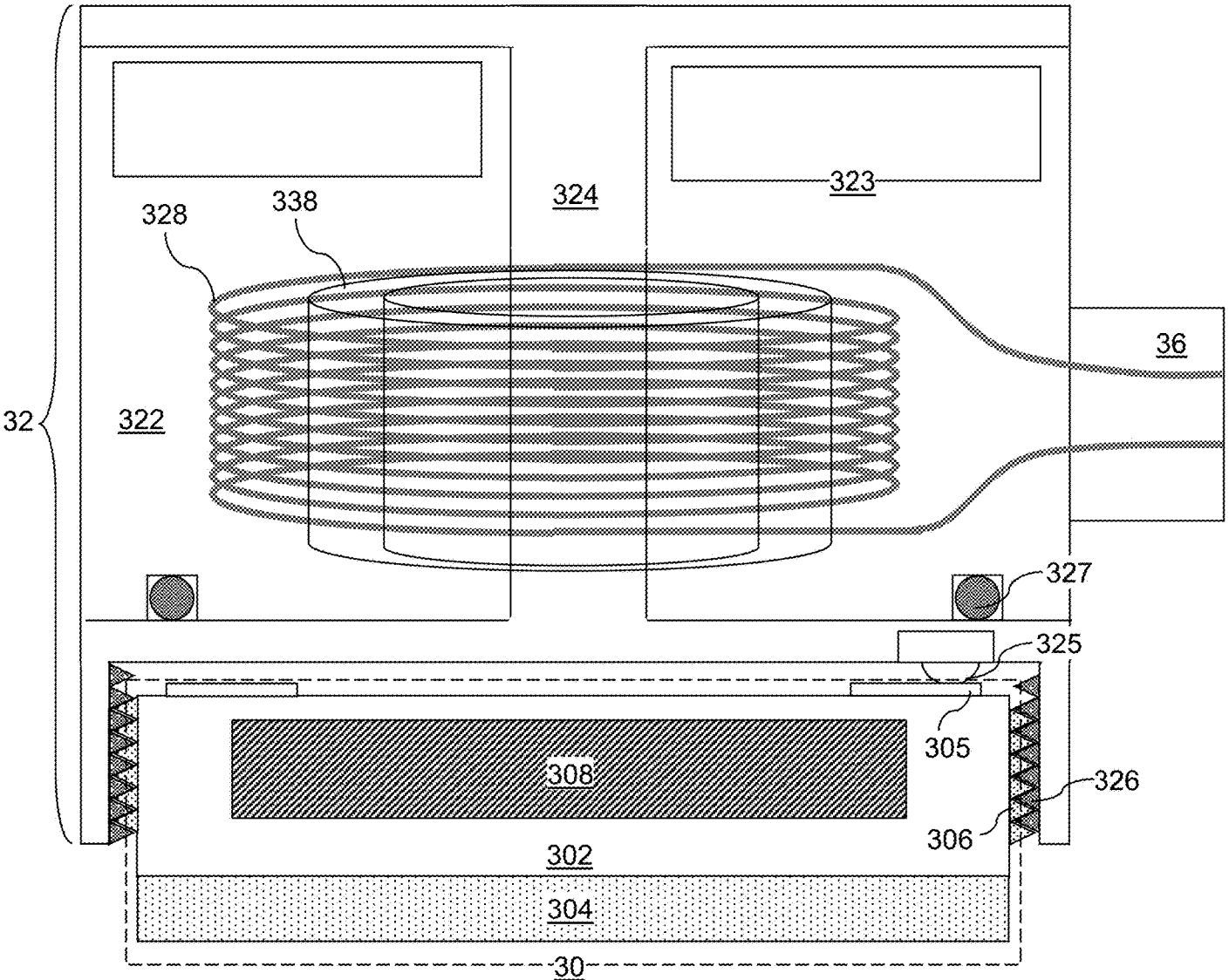
FIG. 2 is a vertical cross-sectional view of a pad conditioning unit according to an embodiment of the present disclosure.
Figure 3:
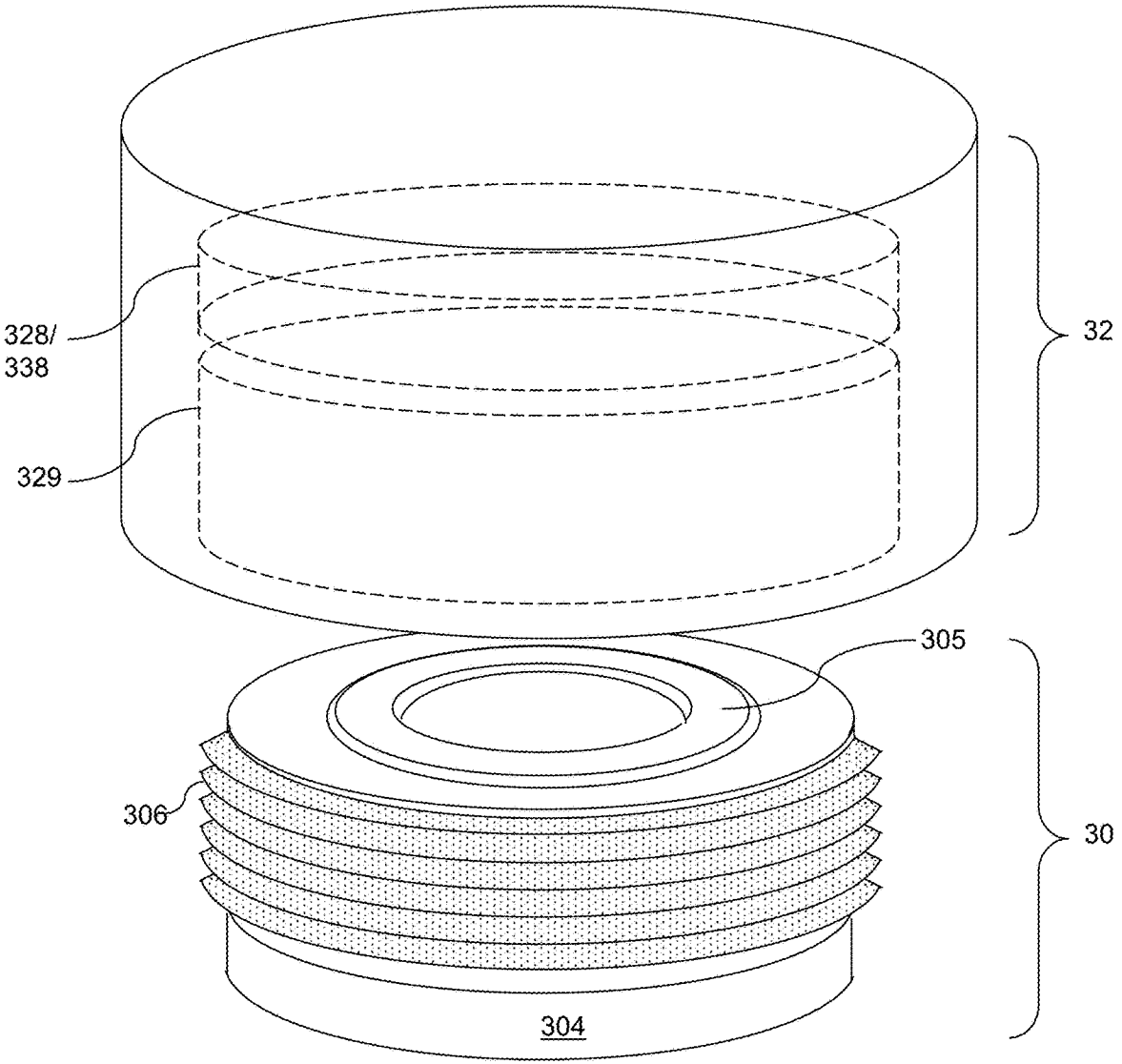
FIG. 3 is a perspective view of the pad conditioning unit while the pad conditioning disk is detached from the conditioning head according to an embodiment of the present disclosure.

FIG. 2 is a vertical cross-sectional view of a pad conditioning unit (30, 32) according to an embodiment of the present disclosure. FIG. 3 is a perspective view of the pad conditioning unit (30, 32) while the pad conditioning disk 30 is detached from the conditioning head 32 according to an embodiment of the present disclosure. Referring collectively to FIGS. 1-3 and according to an aspect of the present disclosure, the pad conditioning disk 30 may be attached to the conditioning head 32 with the assistance of a magnetic force. In one embodiment, the conditioning head 32 comprises an electromagnet, and the pad conditioning disk 30 comprises a first ferromagnetic material portion 308 configured to be attracted to the electromagnet when the electromagnet is energized. When it becomes necessary to detach the pad conditioning disk 30 from the conditioning head 32, the electromagnetic in the conditioning head 32 may be deactivated, and the pad conditioning disk 30 may be removed from the conditioning head 32 without application of excessive force.

The pad conditioning disk 30 may include a disk frame 302 containing the first ferromagnetic material portion 308, an abrasive plate 304 that is permanently attached to the distal surface of the disk frame 302, an optional annular protrusion structure 305 that may be attached to the proximal surface of the disk frame 302, and a screw thread that is herein referred to as an inner screw thread 306. The inner screw thread 306 may be configured to fit a matching screw thread that is provided on a cylindrical inner sidewall of a cylindrical cavity 329 (shown in FIG. 3) located in a bottom portion of the conditioning head 32. The first ferromagnetic material portion 308 may comprise a permanent magnet having a shape of a cylindrical disk. The diameter of the cylindrical disk may be in a range from 30% to 90% of the maximum lateral dimension of the pad conditioning disk. The height of the cylindrical disk of the ferromagnetic material portion 308 may be in a range from 1 mm to 10 mm, although lesser and greater heights may also be used. The first ferromagnetic material portion 308 may have remanence in a range from 0.3 T to 1.5 T. In an illustrative example, the first ferromagnetic material portion 308 may include a ferrite magnet, a samarium-cobalt magnet, an Al—Ni—Co magnet, a neodymium magnet, or a magnet including an alloy of at least one rare earth element and at least one of Fe, Co, and Ni.

The conditioning head 32 comprises a stator unit (322, 323, 328, 338) that is attached to a pad conditioner arm 36 and configured to be stationary relative to the pad conditioner arm 36. Further, the conditioning head 32 comprises a rotor unit (324, 325, 326) that is configured to rotate relative to the stator unit (322, 323, 328, 338), and is attached to the pad conditioning disk 30. The stator unit (322, 323, 328, 338) comprises a stator housing 322 that contains a motor 323 and an electromagnet (328, 338). The rotor unit (324, 325, 326) includes a rotor frame 324 and a helical screw thread that is attached to an inner sidewall of a cylindrical cavity 329 of the rotor frame 324 and is configured to fit the inner screw thread 306. The helical screw thread is herein referred to as an outer screw thread 326. In one embodiment, the stator housing 322 may have a configuration of a cylinder within a vertically extending axial cavity therein, and the rotor frame 324 may include a shaft that vertically extends through the axial cavity within the stator housing 322. The motor 323 may rotate the shaft of the rotor frame 324 so that the pad conditioning disk 30 may rotate during a pad conditioning process. A set of bearings 327 may be provided within an annular groove between the stator housing 322 and the rotor frame 324 to minimize friction during rotation between the stator housing 322 and the rotor frame 324.

According to an aspect of the present disclosure, the rotor frame 324 of the conditioning head 32 may include a cylindrical cavity 329 at a bottom portion thereof. An upper portion of the pad conditioning disk 30 may be configured to fit into the cylindrical cavity 329 of the rotor frame 324 of the conditioning head 32. In one embodiment, the conditioning head 32 comprises an outer screw thread 326 located at a periphery of the cylindrical cavity 329, and the pad conditioning disk 30 comprises an inner screw thread 306 configured to fit the outer screw thread 326. An upper portion of the pad conditioning disk 30 may fit into the cylindrical cavity 329 of the rotor frame 324 of the conditioning head 32 by screwing the inner screw thread 306 into the outer screw thread 326.

In one embodiment, a contact switch 325 may be attached to the rotor unit (324, 325, 326). The contact switch 325 can be located at a top portion of the cylindrical cavity 329 and can be embedded within the rotor frame 324. The contact switch 325 may be configured to detect physical contact with a top surface of the pad conditioning disk 30. In one embodiment, the pad conditioning disk 30 may comprise an annular protrusion structure 305 that faces the contact switch 325. In one embodiment, the process controller 50 may be electrically connected to the contact switch 325, and may be configured to generate an alarm when the contact switch 325 detects absence of physical contact between the contact switch 325 and the top surface of the pad conditioning disk 30, which may be an annular top surface of the annular protrusion structure 305. In other words, the CMP apparatus may be configured to generate an alarm when the pad conditioning disk 30 does not make physical contact with the contact switch 325. Thus, if the pad conditioning disk 30 becomes loose within the cylindrical cavity 329, an alarm may be generated by the process controller 50.

The stator unit (322, 328, 338) may be attached to a pad conditioner arm 36, and is configured to be stationary relative to the pad conditioner arm 36. The pad conditioner arm 36 may be attached to the pad conditioning unit (30, 32), and the conditioner pivot pillar structure 34 may be attached to the pad conditioner arm 36. The pad conditioning unit (30, 32) and the pad conditioner arm 36 may be configured to rotate around a vertical axis passing through the conditioner pivot pillar structure 34.

The stator unit (322, 328, 338) includes the electromagnet (328, 338), which includes a ferromagnetic core 338 comprising a second ferromagnetic material, and a conductive coil 328 that may be wound around the ferromagnetic core 338. The second ferromagnetic material of the ferromagnetic core 338 may include a soft magnetic material. Soft ferromagnetic materials refer to a ferromagnetic material that has high permeability and small coercivity, and thus, has a narrow hysteresis loop. Commercial magnetically soft materials are usually made from alloys of iron and nickel with compositions around $Ni_{80}Fe_{20}$. The coercivity of the soft magnetic material of the ferromagnetic core 338 may be, for example, in a range from 0.1 μT to 10 μT, although lesser and greater coercivities may also be used. Generally, the coercivity of the first hard ferromagnetic material of the first ferromagnetic material portion 308 may be greater than the coercivity of the soft ferromagnetic material of the ferromagnetic core 338 by a factor in a range from 1,000 to 1,000,000.

The ferromagnetic core 338 may guide the magnetic field generated by the conductive coil 328 while the electromagnet (328, 338) may be energized so that the magnetic attraction between the electromagnet (328, 338) and the first ferromagnetic material portion 308 is strong. The low coercivity of the soft ferromagnetic material of the ferromagnetic core 338 minimizes the magnetic force between the electromagnet (328, 338) and the first ferromagnetic material portion 308 while the electromagnet (328, 338) is not energized, and facilitates removal of the pad conditioning disk 30 for replacement or repair.

In one embodiment, a direct current power supply unit configured to provide direct current may be provided within the CMP apparatus. The direct current power supply unit may be electrically connected to the conductive coil 338 by electrical wires connected to ends of the conductive coil 338 and extending through the pad conditioner arm 36. In one embodiment, the direct current power supply unit may be located within the conditioner pivot pillar structure 34, or may be located outside the conditioner pivot pillar structure 34 as an external device. Generally, the direct current power supply unit is configured to provide the direct current to the conductive coil 328 to energize the electromagnet (328, 338). The switching of the electromagnet (328, 338) may be controlled by the process controller 50.

Generally, the chemical mechanical polishing (CMP) apparatus according to an embodiment of the present disclosure includes a polishing pad 12 located on a top surface of a platen 10 configured to rotate around a vertical axis passing through the platen 10; a wafer carrier 40 configured to hold a substrate 41 on a bottom surface thereof and to press the substrate 41 on a top surface of the polishing pad 12; a slurry dispenser 20 configured to dispense slurry 22 over the top surface of the polishing pad 12; and a pad conditioning unit (30, 32) comprising a pad conditioning disk 30 and a conditioning head 32 configured to hold the pad conditioning disk 30, wherein the conditioning head 32 comprises an electromagnet (328, 338) and the pad conditioning disk 30 comprises a first ferromagnetic material portion 308 configured to be attracted to the electromagnet (328, 338) when the electromagnet (328, 338) is energized.

In one embodiment, the CMP apparatus may include the electromagnet (328, 338) which includes: a ferromagnetic core 338 comprising a second ferromagnetic material; and a conductive coil 328 that is wound around the ferromagnetic core 338. In another embodiment, the CMP apparatus may include pad conditioner arm 36 attached to the pad conditioning unit (30, 32); and a conditioner pivot pillar structure 34 attached to the pad conditioner arm 36, wherein the pad conditioning unit (30, 32) and the pad conditioner arm 36 are configured to rotate around a vertical axis passing through the conditioner pivot pillar structure 34. In another embodiment, the CMP apparatus may include a direct current power supply unit configured to provide a direct current to the conductive coil 328 to energize the electromagnet (328, 338). In another embodiment, the first ferromagnetic material portion 308 includes a permanent magnet having a shape of a cylindrical disk. In another embodiment, the conditioning head 32 includes a cylindrical cavity 329; and an upper portion of the pad conditioning disk 30 is configured to fit into the cylindrical cavity 329. In another embodiment, the CMP apparatus may include a contact switch 325 located at a top portion of the cylindrical cavity 329 and configured to detect physical contact with a top surface of the pad conditioning disk 30. In another embodiment, the CMP apparatus may include a process controller 50 electrically connected to the contact switch 325 and configured to generate an alarm when the contact switch 325 detects absence of physical contact between the contact switch 325 and the top surface of the pad conditioning disk 30. In another embodiment, the conditioning head 32 includes: an outer screw thread 326 located at a periphery of the cylindrical cavity 329; and the pad conditioning disk 30 comprises an inner screw thread 306 configured to fit the outer screw thread 326. In another embodiment, the conditioning head 32 may include: a stator unit (322, 323, 328, 338) that is attached to a pad conditioner arm 36 and configured to be stationary relative to the pad conditioner arm 36 and including the electromagnet (328, 338); and a rotor unit (324, 325, 326) that is configured to rotate relative to the stator unit (322, 323, 328, 338) and attached to the pad conditioning disk 30.

Figure 4:
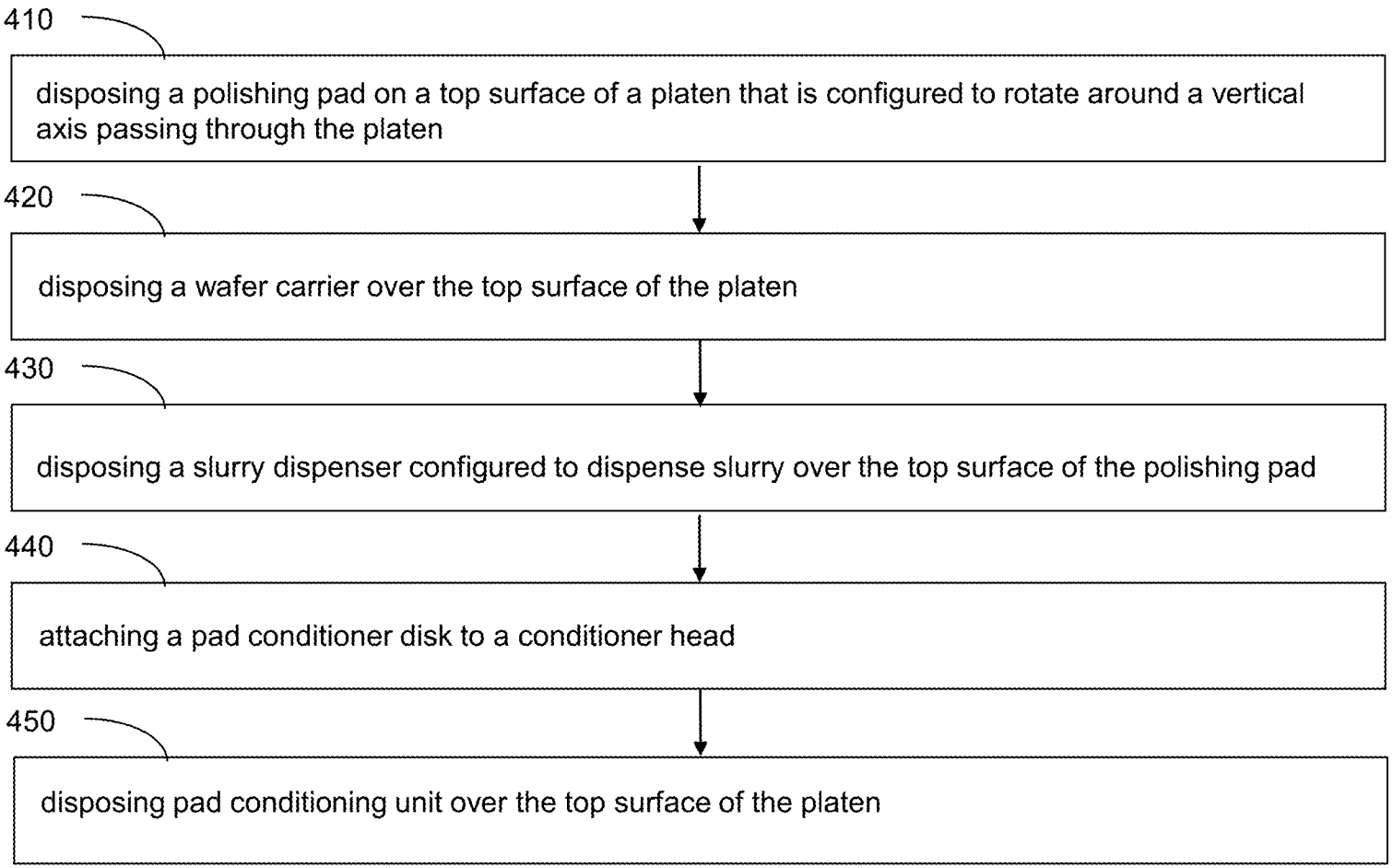
FIG. 4 is a process flow diagram illustrating an exemplary manufacturing process for forming a CMP apparatus according to an embodiment of the present disclosure.

FIG. 4 is a process flow diagram illustrating an exemplary method for manufacturing a CMP apparatus illustrated in FIGS. 1-3 according to an embodiment method of the present disclosure. Referring to step 410, a polishing pad 12 may be disposed on a top surface of a platen 10 that is configured to rotate around a vertical axis passing through the platen 10. Referring to step 420, a wafer carrier 40 may be disposed over the top surface of the platen 10. The wafer carrier 40 is configured to hold a substrate 41 on a bottom surface thereof and to press the substrate 41 onto the top surface of the polishing pad 12. Referring to step 430, a slurry dispenser 20 configured to dispense slurry 22 may be disposed over the top surface of the polishing pad 12. Referring to step 440, a pad conditioning disk 30 is attached to a conditioning head 32. The pad conditioning disk 30 comprises a first ferromagnetic material portion 308 and the conditioning head 32 comprises an electromagnet (328, 338) configured to generate a magnetic field that attracts the first ferromagnetic material portion 308, whereby a pad conditioning unit (30, 32) including the conditioning head 32 and the pad conditioning disk 30 is formed. Referring to step 450, the pad conditioning unit (30, 32) may be disposed over the top surface of the platen 10.

In one embodiment, a pad conditioner arm 36 may be attached to the pad conditioning unit (30, 32), and a conditioner pivot pillar structure 34 may be attached to the pad conditioner arm 36. The pad conditioning unit (30, 32) and the pad conditioner arm 36 may be configured to rotate around a vertical axis passing through the conditioner pivot pillar structure 34.

In one embodiment, the conditioning head 32 comprises a cylindrical cavity 329, and the conditioning head 32 comprises a contact switch 325 located at a top portion of the cylindrical cavity 329 and configured to detect physical contact with the pad conditioning disk 30. In this embodiment, an upper portion of the pad conditioning disk 30 may be fitted into the cylindrical cavity 329. The pad conditioning disk 30 may be moved upward until the contact switch 325 detects physical contact with the pad conditioning disk 30.

In one embodiment, the conditioning head 32 comprises an outer screw thread 326 located at a periphery of the cylindrical cavity 329, and the pad conditioning disk 30 comprises an inner screw thread 306 configured to fit the outer screw thread 326. In this embodiment, the pad conditioning disk 30 may be turned until the pad conditioning disk 30 contacts the contact switch 325. The electromagnet (328, 338) may be turned off during maintenance, such as during turning the pad conditioning disk 30 until the pad conditioning disk 30 contacts the contact switch 325.

In one embodiment, the conditioning head 32 comprises a stator unit (322, 323, 328, 338) that is attached to a pad conditioner arm 36 and is configured to be stationary relative to the pad conditioner arm 36 and including the electromagnet (328, 338), and a rotor unit (324, 325, 326) that is configured to rotate relative to the stator unit (322, 323, 328, 338). The pad conditioning disk 30 is attached to the rotor unit (324, 325, 326).

Figure 5:
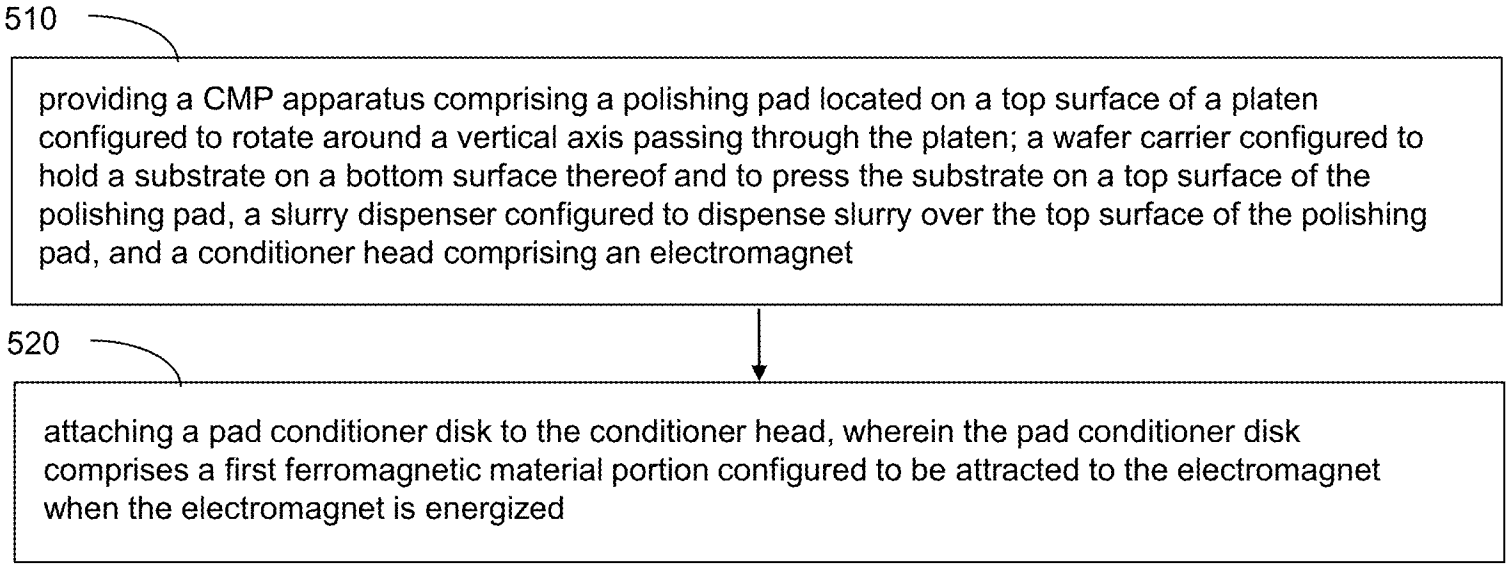
FIG. 5 is a process flow diagram illustrating an exemplary process for operating a CMP apparatus according to an embodiment of the present disclosure.

FIG. 5 is a process flow diagram illustrating an exemplary process for operating a CMP apparatus according to an embodiment of the present disclosure. Referring to step 510, a CMP apparatus of the present disclosure may be provided. The CMP apparatus may comprise: a polishing pad 12 located on a top surface of a platen 10 configured to rotate around a vertical axis passing through the platen 10, a wafer carrier 40 facing a top surface of the polishing pad 12, a slurry dispenser 20 configured to dispense slurry 22 over the top surface of the polishing pad 12, and a conditioning head 32 comprising an electromagnet (328, 338). Referring to step 520, a pad conditioning disk 30 may be attached to the conditioning head 32. The pad conditioning disk 30 comprises a first ferromagnetic material portion 308 configured to be attracted to the electromagnet (328, 338) when the electromagnet (328, 338) is energized. The wafer carrier 40 may be configured to hold the substrate 41 on a bottom surface thereof and to press the substrate 41 on the top surface of the polishing pad 12.

In one embodiment, a substrate 41 may be attached upside down on a bottom surface of the wafer carrier 40 such that a front side of the substrate 41 faces the top surface of the polishing pad 12. The front side of the substrate 41 may be polished by rotating the wafer carrier 40 and the substrate 41 while the platen 10 rotates and while the slurry 22 is present on the top surface of the polishing pad 12.

In one embodiment, the conditioning head 32 comprises a cylindrical cavity 329. An upper portion of the pad conditioning disk 30 may be fitted into the cylindrical cavity 329. In one embodiment, the conditioning head 32 comprises a contact switch 325 located at a top portion of the cylindrical cavity 329. The pad conditioning disk 30 may be moved up the cylindrical cavity 329 until the contact switch 325 detects physical contact with a top surface of the pad conditioning disk 30.

In one embodiment, the electromagnet (328, 338) may be energized by passing electrical current through a conductive coil 328 of the electromagnet (328, 338). The polishing pad 12 may be conditioned by inducing contact between the pad conditioning disk 30 and the polishing pad 12 while the polishing pad 12 rotates around the vertical axis passing through the platen 10 and while the electromagnet (328, 338) is energized.

The embodiments of the present disclosure may be used to provide a CMP apparatus in which a pad conditioning disk 30 is attached to a conditioning head 32 by magnetic force that may be turned on during operation and may be turned off during maintenance. The magnetic coupling between the pad conditioning disk 30 and the conditioning head 32 prevents loosening or dislodging of the pad conditioning disk 30 from the cylindrical cavity 329 of the conditioning head 32, and may increase the tool availability of the CMP apparatus, and may reduce the tool maintenance time of the CMP apparatus of the present disclosure.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A chemical mechanical polishing (CMP) apparatus comprising:

a polishing pad located on a top surface of a platen configured to rotate around a vertical axis passing through the platen;

a wafer carrier configured to hold a substrate on a bottom surface thereof and to press the substrate on a top surface of the polishing pad;

a slurry dispenser configured to dispense slurry over the top surface of the polishing pad; and a pad conditioning unit comprising a pad conditioning disk and a conditioning head configured to hold the pad conditioning disk, wherein the conditioning head comprises an electromagnet and the pad conditioning disk comprises a first ferromagnetic material portion configured to be attracted to the electromagnet when the electromagnet is energized, wherein the conditioning head comprises a cylindrical cavity that contains an outer screw thread on an inner sidewall thereof, wherein the pad conditioning disk comprise an inner screw thread as an outermost laterally protruding structure of the pad conditioning disk, and wherein the inner screw thread is configured to fit the outer screw thread.

2. The CMP apparatus of claim 1, wherein the electromagnet comprises:

a ferromagnetic core comprising a second ferromagnetic material; and a conductive coil that is wound around the ferromagnetic core.

3. The CMP apparatus of claim 2, further comprising:

a pad conditioner arm attached to the pad conditioning unit; and a conditioner pivot pillar structure attached to the pad conditioner arm, wherein the pad conditioning unit and the pad conditioner arm are configured to rotate around a vertical axis passing through the conditioner pivot pillar structure.

4. The CMP apparatus of claim 3, further comprising a direct current power supply unit configured to provide a direct current to the conductive coil to energize the electromagnet.

5. The CMP apparatus of claim 1, wherein the first ferromagnetic material portion comprises a permanent magnet having a shape of a cylindrical disk.

6. The CMP apparatus of claim 1, wherein:

an upper portion of the pad conditioning disk is configured to fit into the cylindrical cavity.

7. The CMP apparatus of claim 6, further comprising a contact switch located at a top portion of the cylindrical cavity and configured to detect physical contact with a top surface of the pad conditioning disk.

8. The CMP apparatus of claim 7, further comprising a process controller electrically connected to the contact switch and configured to generate an alarm when the contact switch detects absence of physical contact between the contact switch and the top surface of the pad conditioning disk.

9. The CMP apparatus of claim 1, wherein the conditioning head comprises:

a stator unit that is attached to a pad conditioner arm and configured to be stationary relative to the pad conditioner arm and including the electromagnet; and a rotor unit that is configured to rotate relative to the stator unit and attached to the pad conditioning disk.

10. A method of manufacturing a chemical mechanical polishing (CMP) apparatus, the method comprising:

disposing a polishing pad on a top surface of a platen that is configured to rotate around a vertical axis passing through the platen;

disposing a wafer carrier over the top surface of the platen, wherein the wafer carrier is configured to hold a substrate on a bottom surface thereof and to press the substrate onto the top surface of the polishing pad;

disposing a slurry dispenser configured to dispense slurry over the top surface of the polishing pad;

attaching a pad conditioning disk to a conditioning head, wherein the pad conditioning disk comprises a first ferromagnetic material portion and the conditioning head comprises an electromagnet configured to generate a magnetic field that attracts the first ferromagnetic material portion, whereby a pad conditioning unit including the conditioning head and the pad conditioning disk is formed; and disposing the pad conditioning unit over the top surface of the platen, wherein:

the conditioning head comprises a cylindrical cavity;

the conditioning head comprises a contact switch located at a top portion of the cylindrical cavity and configured to detect physical contact with the pad conditioning disk; and the method comprises fitting an upper portion of the pad conditioning disk into the cylindrical cavity and moving the pad conditioning disk upward until the contact switch detects physical contact with the pad conditioning disk.

11. The method of claim 10, further comprising:

attaching a pad conditioner arm to the pad conditioning unit; and attaching a conditioner pivot pillar structure to the pad conditioner arm, wherein the pad conditioning unit and the pad conditioner arm are configured to rotate around a vertical axis passing through the conditioner pivot pillar structure.

12. The method of claim 10, wherein:

the conditioning head comprises an outer screw thread located at a periphery of the cylindrical cavity;

the pad conditioning disk comprises an inner screw thread configured to fit the outer screw thread; and the method comprises turning the pad conditioning disk until the pad conditioning disk contacts the contact switch.

13. The method of claim 10, wherein the conditioning head comprises:

a stator unit that is attached to a pad conditioner arm and configured to be stationary relative to the pad conditioner arm and including the electromagnet; and a rotor unit that is configured to rotate relative to the stator unit, wherein the pad conditioning disk is attached to the rotor unit.

14. A method of operating a chemical mechanical polishing (CMP) apparatus, comprising:

providing a CMP apparatus comprising:

a polishing pad located on a top surface of a platen configured to rotate around a vertical axis passing through the platen, a wafer carrier facing a top surface of the polishing pad, a slurry dispenser configured to dispense slurry over the top surface of the polishing pad, and a conditioning head comprising an electromagnet; and attaching a pad conditioning disk to the conditioning head, wherein the pad conditioning disk comprises a first ferromagnetic material portion configured to be attracted to the electromagnet when the electromagnet is energized, wherein:

the conditioning head comprises a cylindrical cavity;

the method comprises fitting an upper portion of the pad conditioning disk into the cylindrical cavity;

the conditioning head comprises a contact switch located at a top portion of the cylindrical cavity; and the method comprises moving the pad conditioning disk up the cylindrical cavity until the contact switch detects physical contact with a top surface of the pad conditioning disk.

15. The method of claim 14, further comprising:

attaching a substrate upside down on a bottom surface of the wafer carrier such that a front side of the substrate faces the top surface of the polishing pad; and polishing the front side of the substrate by rotating the wafer carrier and the substrate while the platen rotates and while the slurry is present on the top surface of the polishing pad.

16. The method of claim 14, further comprising:

energizing the electromagnet by passing electrical current through a conductive coil of the electromagnet; and conditioning the polishing pad by inducing contact between the pad conditioning disk and the polishing pad while the polishing pad rotates around the vertical axis passing through the platen and while the electromagnet is energized.

17. The CMP apparatus of claim 1, wherein the inner screw thread laterally surrounds the first ferromagnetic material portion.

18. The CMP apparatus of claim 1, wherein the inner screw thread is located on a cylindrical sidewall of the disk that extends between a first surface of the pad conditioning disk that faces a recessed surface of the cylindrical cavity of the conditioning head and a second surface of the pad conditioning disk that faces the polishing pad.

19. The CMP apparatus of claim 17, wherein:

the pad conditioning disk comprises an abrasive plate that is more distal from the electromagnet than the inner screw thread is from the electromagnet; and the second surface of the pad conditioning disk is a surface of the abrasive plate.

20. The CMP apparatus of claim 1, wherein the inner screw thread is in direct contact with the outer screw thread.

* * * * *